US007940949B2

(12) United States Patent
Kloman, III

(10) Patent No.: US 7,940,949 B2
(45) Date of Patent: May 10, 2011

(54) UNIVERSAL AUDIO SPEAKER MOUNT AND KITS AND METHODS FOR INSTALLATION

(76) Inventor: John McKenna Kloman, III, Oakton, VA (US)

( * ) Notice: Subject to any disclaimer, the term of this patent is extended or adjusted under 35 U.S.C. 154(b) by 57 days.

(21) Appl. No.: 12/468,985

(22) Filed: May 20, 2009

(65) Prior Publication Data

US 2009/0238401 A1 Sep. 24, 2009

Related U.S. Application Data

(62) Division of application No. 10/936,810, filed on Sep. 9, 2004, now Pat. No. 7,539,322.

(51) Int. Cl.
*H04R 25/00* (2006.01)

(52) U.S. Cl. ..... 381/386; 381/361; 381/395

(58) Field of Classification Search ..... 381/152, 381/182, 345, 361–368, 386–395
See application file for complete search history.

(56) References Cited

U.S. PATENT DOCUMENTS

| | | | | |
|---|---|---|---|---|
| 2,670,053 | A | 2/1954 | Doms | 181/27 |
| 4,032,725 | A | 6/1977 | McGee | 179/146 R |
| 4,277,653 | A | 7/1981 | Pawelzick | 179/146 E |
| 4,296,280 | A | 10/1981 | Richie | 179/1 E |
| 4,451,711 | A | 5/1984 | Jackson | 179/146 E |
| 5,412,162 | A | 5/1995 | Kindel | 181/150 |
| D360,634 | S | 7/1995 | Alleva | D14/211 |
| 5,661,271 | A | 8/1997 | Moser | 181/199 |
| 5,900,594 | A | 5/1999 | Monson | 181/199 |
| 6,035,962 | A | 3/2000 | Lin | 181/199 |
| 6,609,589 | B2 | 8/2003 | Combest | 181/150 |

FOREIGN PATENT DOCUMENTS

| | | |
|---|---|---|
| JP | 5344575 | 12/1993 |

*Primary Examiner* — Suhan Ni
(74) *Attorney, Agent, or Firm* — Murphy & King, P.C.

(57) ABSTRACT

A universal audio speaker mounting board for speaker systems that simulates the structural surface that traditional flush-mounted speakers are mounted to, thus providing the ability to use a variety of flush-mount speakers in a variety of encasements, such as bookshelf enclosures or cabinets. Methods of installation and kits for installation are also contemplated.

20 Claims, 7 Drawing Sheets

UNIVERSAL AUDIO SPEAKER MOUNT AND KITS AND METHODS FOR INSTALLATION

CROSS-REFERENCE TO RELATED APPLICATIONS

This application is a divisional of U.S. patent application Ser. No. 10/936,810, filed Sep. 9, 2004 now U.S. Pat. No. 7,539,322, which is incorporated by reference in its entirety.

FIELD OF THE INVENTION

The present invention relates to a universal audio speaker mounting board that is cost-effective, easy to use, and adaptable to numerous audio speaker mounting scenarios. In particular, the mounting board of the present invention simulates the structural surface that traditional flush-mounted speakers are mounted to, thus providing the ability to use a variety of such speakers in a variety of encasements, such as bookshelf enclosures or cabinets. As used herein, "flush-mounted speakers" encompass and include speakers known as and commonly referred to as "recessed speakers," "in-wall speakers" "in-ceiling speakers" and "surface-mount speakers" by those of ordinary skill in the art. The present invention also encompasses methods of installing a speaker using the mounting board, as well as kits for installation.

BACKGROUND OF THE INVENTION

Audio and home theater speaker systems are frequently designed to include speakers that are flush-mounted into the walls, ceiling, or other surfaces of a room. The flush-mount speakers are installed within a structure, such as wallboard, via an adjustable bracket that adjusts to the thickness of the structure. Once the speaker is mounted, only the grille and the bezel are exposed. The position of the speaker is selected at the time of installation such that the desired aesthetic effect and acoustic results are obtained.

When the wall design, ceiling height, or other attributes of a room prevents flush-mounting, conventional box-type speakers, i.e., cabinet speakers or bookshelf speakers, are employed. The box-type speakers, however, typically do not match the flush-mount speakers, both in design and sound. As such, box-type speakers are often difficult to position in a manner that is aesthetically desirable or that provides the desired acoustical effect. In addition, conventional box-type speakers are generally more expensive than flush-mounted speakers. Finally, the installation of the system may be more difficult due to the integration of the different types of speakers.

Thus, there exists a need for a universal audio speaker mount that allows installation of a speaker intended for flush-mounting into a conventional box-type speaker enclosure. Such a mount would provide an installer the option of maintaining the same design, sound, and quality in a speaker system, for example, when the walls or ceilings do not allow a flush-mount installation.

SUMMARY OF THE INVENTION

The present invention is directed to a universal audio speaker mount including a mounting board having a front side and a back side and a first pattern appearing on at least one of the front side or back side, wherein the pattern includes a plurality of cutting guides adaptable to at least two speaker sizes, and wherein the mounting board is formed of sheet material including gator board, foam-core board, corrugated cardboard, plastic, honeycomb board, cork, sheetrock, fiber-reinforced polymer, and combinations thereof. In one embodiment, the first pattern includes horizontal and vertical cutting guides spaced at intervals of 0.25 inches. In another embodiment, the first pattern includes cutting guides of concentric circles spaced at intervals of 0.25 inches. The mounting board may be formed of foam-core board having a thickness of about 0.5 inches to about 0.625 inches.

In this aspect of the invention, the mounting board has an outer perimeter, and wherein the mounting board has a border of 0.25 inches around the outer perimeter. The pattern may be adaptable to at least 4 speaker sizes, preferably at least 6 speaker sizes.

In one embodiment, the mounting board has a first pattern on the front side and a second pattern on the back side, and wherein the first pattern has a plurality of horizontal cutting guides and a plurality of vertical cutting guides, and wherein the second pattern includes a plurality of cutting guides having a circular shape, an elliptical shape, a hexagonal shape, or an octagonal shape. In another embodiment, the first pattern is printed onto the mounting board.

The present invention is also directed to a kit for a universal audio speaker mount including (1) a mounting board having a front side and a back side and a first pattern appearing on at least one of the front side or back side, wherein the pattern includes a plurality of cutting guides adaptable to at least two speaker sizes, and wherein the mounting board is formed of sheet material including gator board, foam-core board, corrugated cardboard, plastic, honeycomb board, cork, sheetrock, fiber-reinforced polymer, and combinations thereof; (2) a box-type speaker enclosure including a mounting board frame and speaker connection wires; (3) a cutting device; (4) a fastening device; and (5) a plurality of fasteners.

In one embodiment, the mounting board in the kit has a first pattern on the front side and a second pattern on the back side, and wherein the first pattern has a plurality of horizontal cutting guides and a plurality of vertical cutting guides, and wherein the second pattern includes a plurality of cutting guides having a circular shape, an elliptical shape, a hexagonal shape, or an octagonal shape. In another embodiment, the plurality of cutting guides of the second pattern includes a first cutting guide in a circular shape having a first diameter, a second cutting guide in a circular shape having a second diameter at least 0.5 inches greater than the first diameter, and a third cutting guide in a circular shape having a third diameter at least 0.5 inches greater than the second diameter.

In this aspect of the invention, the fastening device in the kit may be a screwdriver, the plurality of fasteners may include at least four screws, and the cutting device may include a razor blade. Moreover, the mounting board frame may include corner mounts at each of the four corners of the box-type speaker enclosure.

The present invention is also related to a method of installing a flush-mount speaker into a box-type speaker enclosure including the following steps:

- selecting a flush-mount speaker having speaker wire terminals;
- selecting a box-type speaker enclosure having a grille cloth and speaker wires;
- providing a mounting board having a front side and a back side and a first pattern appearing on at least one of the front side or back side, wherein the pattern includes a plurality of cutting guides adaptable to a plurality of speaker sizes;
- cutting an opening in the mounting board using a set of cutting guides corresponding to the speaker size to form an adapted mounting board;

removing the grille cloth from the box-type speaker enclosure to form an cavity;

inserting the adapted mounting board into the cavity by fastening the adapted mounting board to the speaker enclosure;

connecting the speaker wires to the speaker wire terminals;

securing the speaker to the mounting board;

replacing the grille cloth on the box-type speaker enclosure.

In one embodiment, the mounting board is formed of sheet material including gator board, foam-core board, corrugated hardware or cardboard, plastic, honeycomb board, cork, sheetrock, fiber-reinforced polymer, and combinations thereof.

BRIEF DESCRIPTION OF THE DRAWINGS

Further features and advantages of the invention can be ascertained from the following detailed description that is provided in connection with the drawing(s) described below.

DETAILED DESCRIPTION OF THE INVENTION

Figure 1:
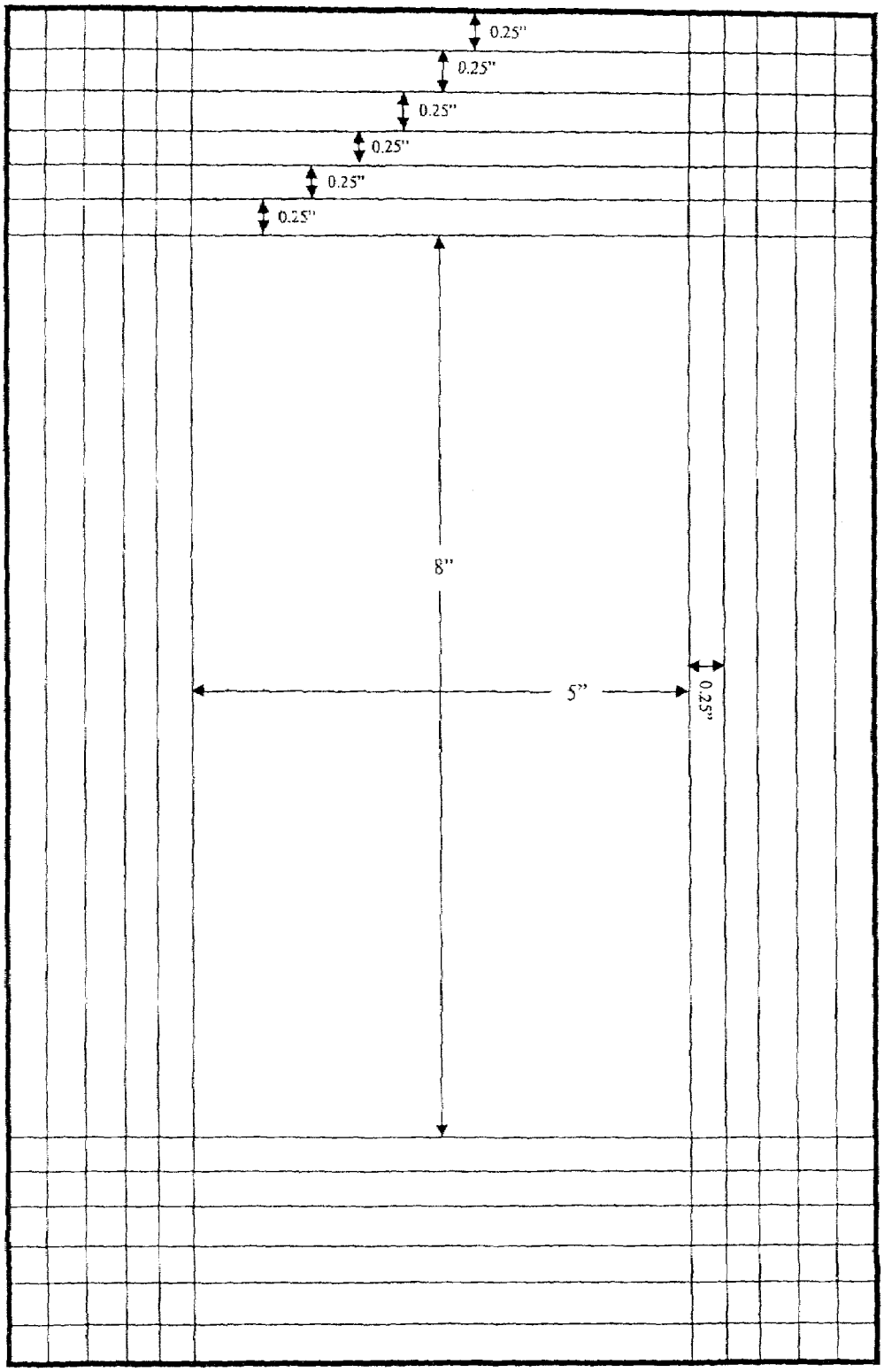
FIG. 1 is a 2-dimensional view of a mounting board of the present invention including a linear pattern.

The present invention relates to a universal audio speaker mount that is adaptable to a variety of flush-mount speaker types, sizes, and shapes. In addition, the present invention contemplates the use of the universal audio speaker mount in a variety of box-type speaker enclosures of varying designs, shapes, and aesthetic qualities. Furthermore, the present invention is directed to installation kits including the universal audio speaker mount of the present invention, a speaker enclosure, and various installation tools and instructions. Finally, the present invention relates to methods of speaker installation using the universal audio speaker mount of the present invention.

Mounting Board

The mounting board includes at least one grid or pattern that has a plurality of cutting guides for use with a particular type of speaker. In one embodiment, the grid is designed to be used with a variety of rectangular or square flush-mount speakers. Thus, the grid includes a plurality of horizontal and vertical cutting guides spaced at appropriate intervals starting from a portion of the board relative to the center and extending toward the perimeter of the mounting board. The cutting guides may begin at any distance from the center, but are preferably designed such that the mount is adaptable to most flush-mount or in-wall speakers. In one embodiment, the grid includes horizontal and vertical cutting guides that begin at a distance of at least about 0.25 inches from the center. In another embodiment, the horizontal and vertical cutting guides begin at a distance of at least about 0.5 inches from the center, preferably about 0.75 inches or greater. In still another embodiment, the cutting guides begin at a distance of about 1 inch or greater from the center. Subsequent cutting guides are preferably spaced about 0.13 inches or greater away from adjacent cutting guides. In one embodiment, the space between adjacent cutting guides is about 0.25 inches or greater. In another embodiment, the space between cutting guides is about 0.375 inches or greater. In yet another embodiment, the cutting guides are spaced at least about 0.5 inches apart.

To maintain the integrity of the mounting board, i.e., to provide sturdiness to the mount, a sufficient portion of the perimeter of the mounting board should remain uncut. As such, the grid or pattern should be designed in a manner such that at least about 0.13 inches or more remains after cutting. In one embodiment, the grid or pattern is designed so that about 0.25 inches or more of the outer perimeter of the mounting board will remain intact after cutting. In another embodiment, the grid or pattern is designed so that about 0.375 inches or more of the mounting will remain intact after cutting. As those of ordinary skill in the art will appreciate, the portion of the perimeter of the mounting board that should remain uncut will greatly depend on the type of material used for the mounting board. For example, when a less rigid material is used for the mounting board, a larger portion of the perimeter will need to remain uncut to provide the requisite sturdiness to the speaker mount.

A non-limiting example of a mounting board having a linear grid printed thereon is shown in FIG. 1. The grid includes a first set of horizontal cutting guides that appear on the mounting board providing an overall speaker height of about 8 inches, i.e., each horizontal cutting guide is spaced about 4 inches from the center of the mounting board. Subsequent horizontal cutting guides are spaced at about 0.25 inches intervals extending toward the outer perimeter of the mounting board. Likewise, vertical cutting guides are included in the grid such that the overall speaker width is about 5 inches, i.e., each vertical cutting guide is spaced about 2.5 inches from the center of the mounting board. Subsequent vertical cutting guides are spaced at about 0.25 inches intervals extending toward the outer perimeter of the mounting board. Both sets cutting guides end about 0.25 inches from the outer edge of the mounting board.

Figure 2:
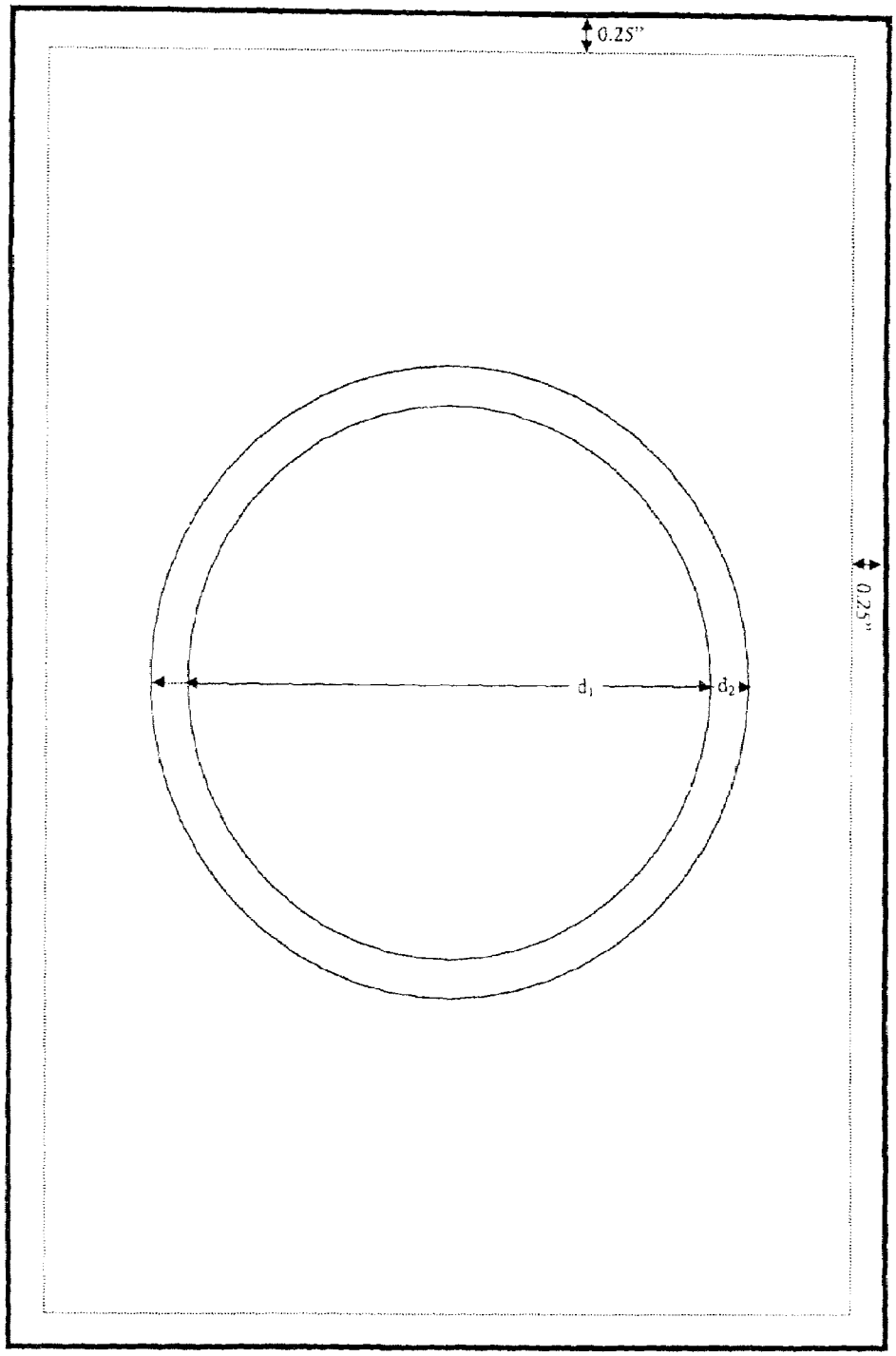
FIG. 2 is a 2-dimensional view of a mounting board of the present invention including a circular pattern.

In another embodiment, the mounting board includes a pattern of concentric circles. For example, as shown in FIG. 2, the pattern may include a first circle of a specific diameter and a second circle having a larger diameter than the first circle. The amount of increase in circle diameter from the first circle to the outer circle is not critical. In one embodiment, the second circle has a diameter that is at least about 0.25 inches larger than the first circle. In another embodiment, the diameter of the second circle is at least about 0.375 inches larger than the first circle. In yet another embodiment, the diameter of the second circle is at least about 0.5 inches greater than the first circle.

While only two circles are shown in FIG. 2, those of ordinary skill in the art would appreciate that the pattern may include a plurality of circles that become increasingly larger providing that at least a portion of the mounting board, e.g., about 0.25 inches surrounding the perimeter, is maintained after cutting. In fact, the circular pattern shown in FIG. 2 may include a first circle having a diameter of 3 inches, a second circle having a diameter of 3.25 inches, a third circle having a diameter of 3.5 inches, etc., such that the pattern utilizes a major portion of the mounting board yet is designed such that at least about 0.25 inches or more of the outer perimeter of the mounting board is left intact after cutting.

Figure 3:
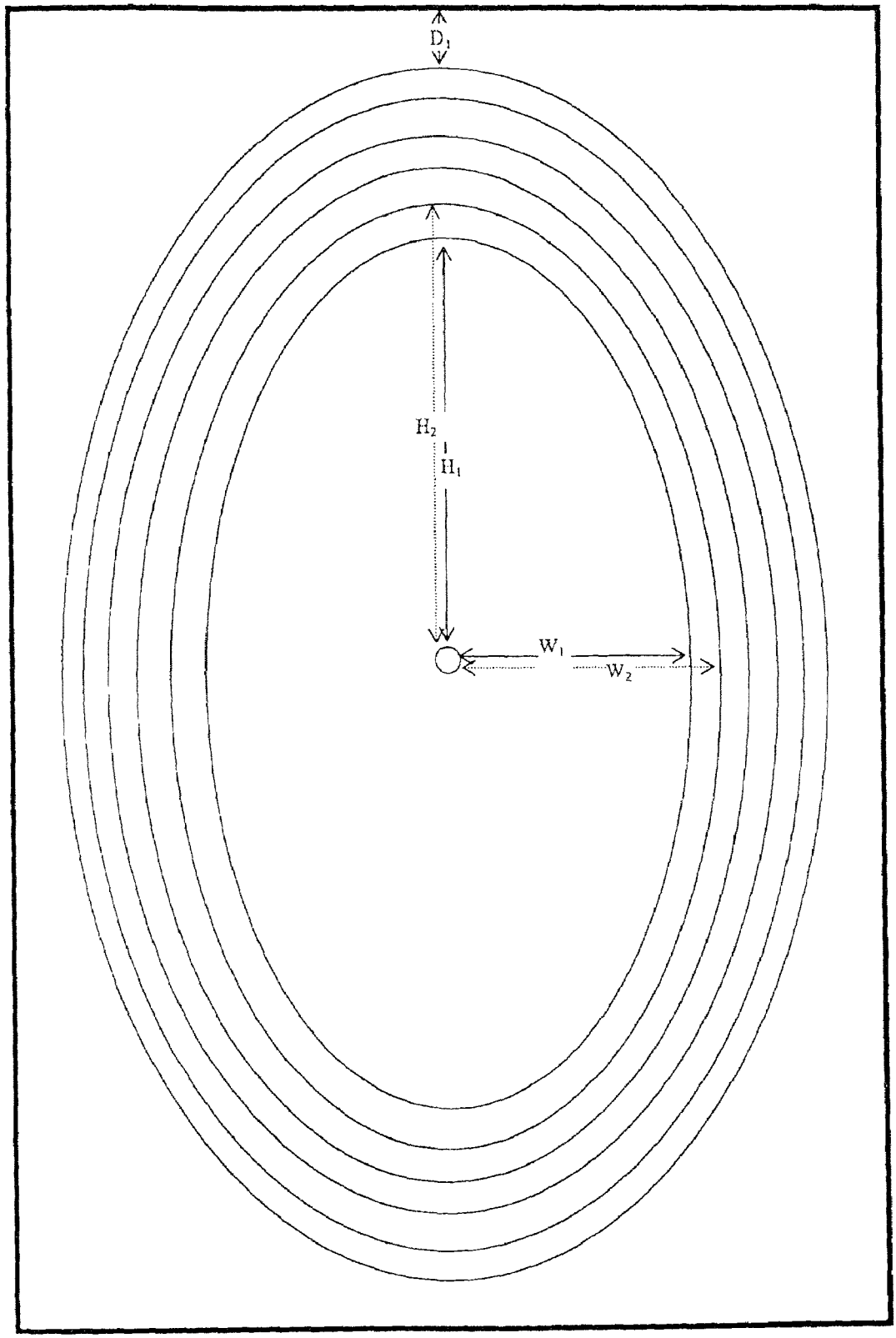
FIG. 3 is a 2-dimensional view of a mounting board of the present invention including an elliptical pattern.
Figure 4:
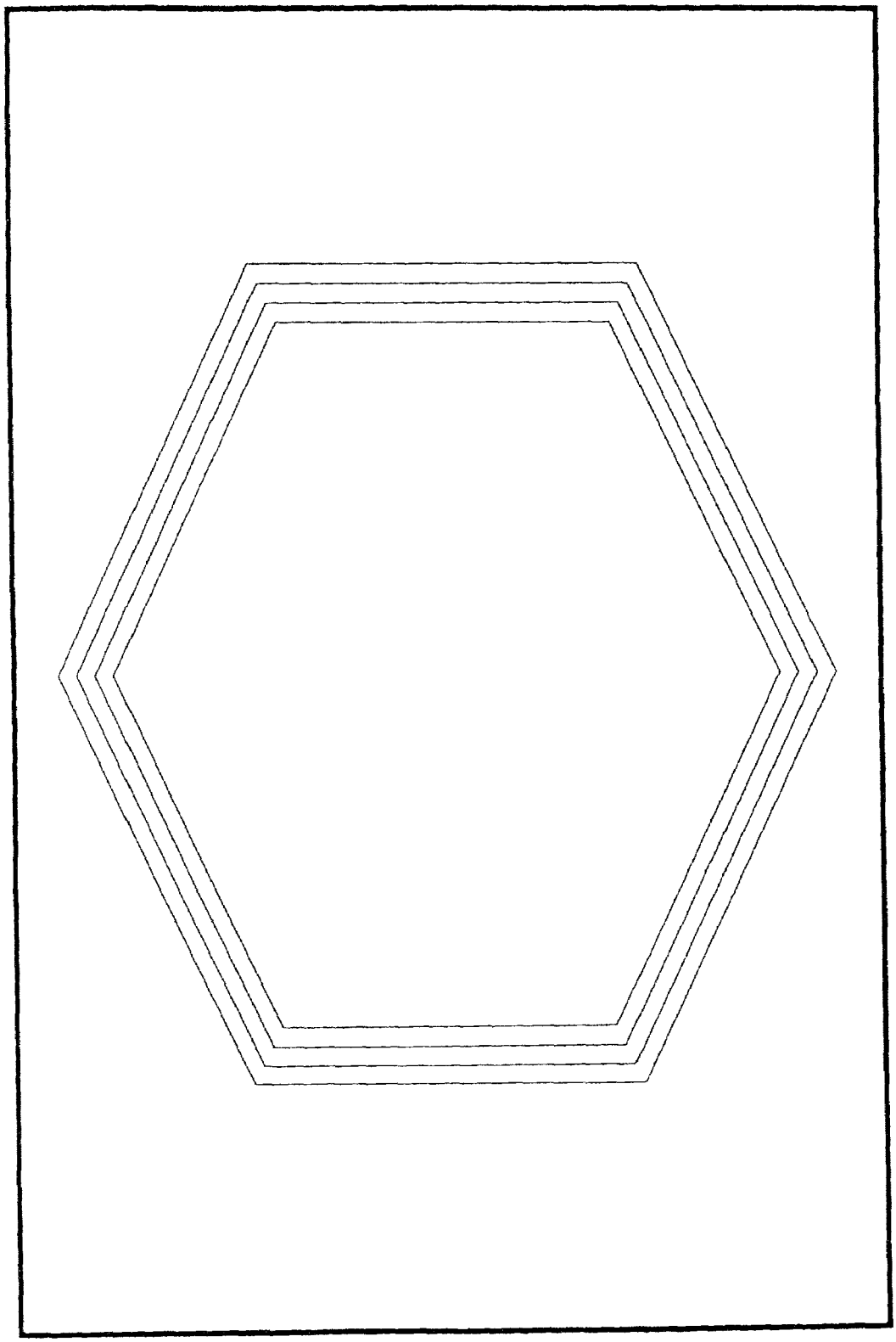
FIG. 4 is a 2-dimensional view of a mounting board of the present invention including a hexagonal pattern.
Figure 5:
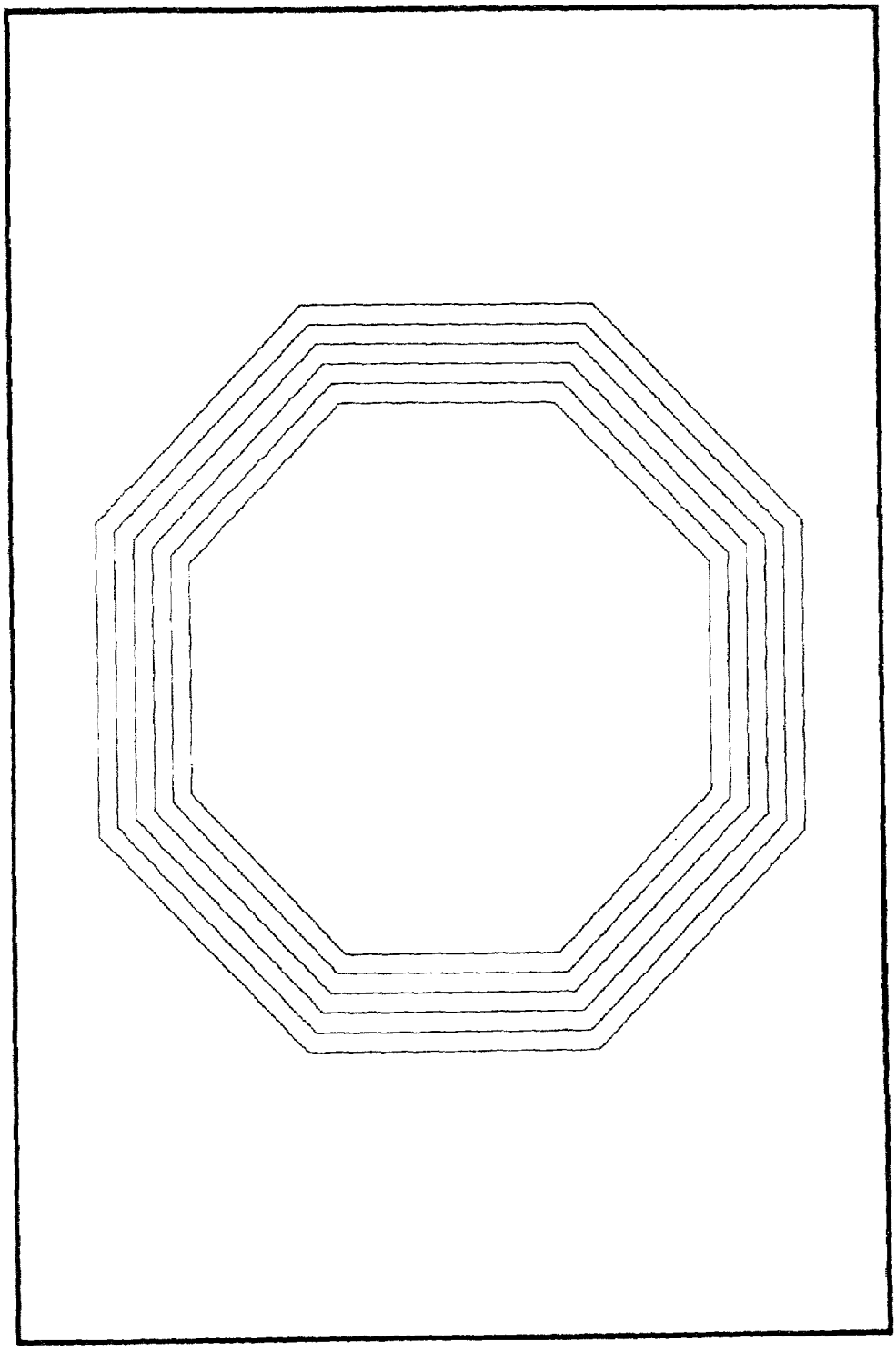
FIG. 5 is a 2-dimensional view of a mounting board of the present invention including an octagonal pattern.

The mounting board may also include a grid or pattern such as those shown in FIGS. 3-5. FIG. 3 illustrates a mounting board with a grid or pattern based on ellipses. The first ellipse, i.e., the centermost ellipse, appears on the mounting board at a predetermined width ($W_1$) and height ($H_1$) from the center of the mounting board. The next ellipse is spaced at a predetermined interval from the first ellipse at width $W_2$ and height $H_2$, where $W_2$ and $H_2$ are greater than $W_1$ and $H_1$. The difference between $W_1$ and $W_2$ is preferably about 0.13 inches or greater, and more preferably about 0.25 inches or greater. Likewise, the difference between $H_1$ and $H_2$ is preferably about 0.25 inches or greater, and more preferably about 0.25 inches or greater.

FIG. 4 shows a mounting board having a pattern based on hexagonal cutting guides. The centermost hexagon has a first height and width (from the center of the mounting board) and the adjacent hexagon larger than the centermost hexagon (having a second height and width greater than the first height and width). Each subsequent adjacent hexagon is larger than the previous and the space between the cutting guides is at least about 0.13 inches or more, preferably about 0.25 inches or more. In another aspect, FIG. 5, the mounting board has a pattern based on octagonal cutting guides. Like the previous figures, as the octagons progress toward the outer perimeter of the mounting board, the size of the octagon increases such that the space between the cutting guides is about 0.13 inches or greater, preferably about 0.25 inches or greater.

In another embodiment, the mounting board includes two different types of grids or patterns. For instance, the mounting board may include a linear pattern on one side and a circular or elliptical pattern on its opposite side.

The grid or pattern may be printed using conventional printing methods, i.e., offset printing, digital printing, and pad-printing. In one embodiment, the grids are first printed onto a transfer medium and then adhesively connected to the mounting board in a separate step. The application of the grids to the mounting boards may be achieved through a variety of methods, all within the knowledge of those of ordinary skill in the art. For example, in one embodiment, the grids or patterns are adhesively connected to the mounting board after being printed on a separate, flexible medium. In another embodiment, the cutting guides are printed directly onto the mounting board. In another embodiment, the cutting guides are impressed or stamped directly into the mounting board surface. In yet another embodiment, the grid is painted onto the mounting board. In still another embodiment, the grid is etched into the mounting board using a laser device.

Because the universal audio speaker mount is intended to be encased in a box-type speaker enclosure, the mounting board may be of any size that is suitable for box-type speaker enclosures. For example, most box-type speaker enclosures are about 2 inches to about 24 inches wide and about 2 inches to about 30 inches high. Thus, the mounting board can have a corresponding width of about 2 inches to about 24 inches and a height of about 2 inches to 30 inches. In one embodiment, the mount has a width and height of about 4 inches to about 16 inches. In another embodiment, the width and height of the mounting board is about 6 inches to about 12 inches. In still another embodiment, the width of the mounting board is about 6 inches to about 1) inches and the height of the mount is about 6 inches to about 12 inches. For example, the mounting board may be designed to fit a typical bookshelf speaker, i.e., a width of about 6 inches or greater and a height of about 6 inches or greater. As discussed above, however, regardless of the size of the mounting board, the grid or pattern appearing thereon should be designed to allow for a sufficient outer perimeter that remains uncut to maintain the structural integrity of the mounting board.

In addition to the outer perimeter of the mounting board, the structural integrity of the mounting board is a function of the type of material and thickness of the material used to fabricate the mounting board. Thus, the universal audio speaker mount is preferably formed of a material that has sufficient rigidity to simulate wallboard, but flexible enough to be cut or constructed in the field, i.e., during installation, with a handheld cutting device, as discussed in more detail below with regard to the kits of the invention and the methods for installation. Examples of suitable materials include, but are not limited to, gator board, foam-core board, corrugated cardboard (or hardware) or plastic, honeycomb board, cork, sheetrock, fiber-reinforced polymer, and combinations thereof. Gator board is made from a combination of strong styrofoam, poly-styrene and a multilayered resin impregnated paper. Foam-core board, which is typically slightly less rigid than gator board and, thus, easier to cut, has an inner medium of foam and an outer liner of a high quality paper board. Corrugated hardware is a paper product comprised of a medium (the inner fluted part) sandwiched between linerboards (the outer paper faces). Honeycomb board, which is typically more expensive than foam-core and corrugated hardware, is a sheet material in which a paperboard honeycomb medium is sandwiched between paperboard liners.

In one embodiment, the thickness of the mounting board preferably ranges from about 0.1 inches to about 2 inches, however, one of ordinary skill in the art would be appreciate that a mounting board of any appreciable thickness may be used providing that the speaker is adequately stable within the mount. In one embodiment, the mounting board is about 0.25 inches to about 1.5 inches. In another embodiment, the thickness of the mounting board is about 0.5 inches to about 1 inch. For example, the mounting board may mimic the thickness of conventional wallboard, e.g., 0.5 inches to about 0.625 inches, or its structural rigidity or density.

Speaker Enclosure

The universal audio speaker mount of the present invention may be used with any type of conventional box-type speaker enclosure. The box-type speaker enclosure may be from about 2 inches to about 24 inches wide and about 2 inches to about 30 inches high. In one embodiment, the speaker enclosure has a width and height of about 4 inches to about 16 inches. In another embodiment, the width and height of the speaker enclosure is about 6 inches to about 12 inches. In still another embodiment, the width of the speaker enclosure is about 6 inches to about 10 inches and the height of the speaker enclosure is about 6 inches to about 12 inches.

Figure 6:
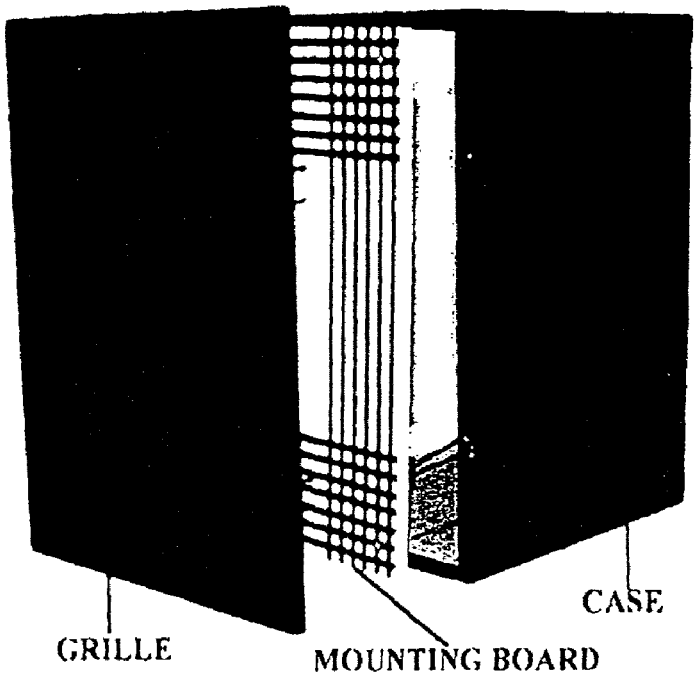
FIG. 6 is a 3-dimensional view of a speaker enclosure, the mounting board of the present invention, and a grille cloth.

The speaker enclosure may include a grille cloth, as shown in FIG. 6, with sufficient rigidity to maintain its pre-formed shape while supported only at its periphery, as disclosed in U.S. Pat. No. 5,412,162, which is incorporated in its entirety by reference herein. In addition, conventional grille cloths, i.e., those mounted to a rigid structure such as metal, wood, plastic, and the like are contemplated for use with the present invention. Furthermore, foam covers and other covers for visually obscuring the components of the speaker assembly are contemplated for use with the speaker enclosure. Those of ordinary skill in the art should be aware that a foam cover must be thick enough to obscure the internal components of the speaker assembly, yet not too thick so as to interfere with sound transmission. In addition, when the universal audio speaker mount of the present invention is used with a foam cover, the foam material preferably includes at least one ultraviolet stabilizer so as to prevent degradation of the foam material, e.g., fading and becoming brittle, from ultraviolet rays.

Connection jacks are typically found on the back of the speaker enclosure for connecting the speaker wires to wires from an audio source such as an amplifier. Any type of suitable speaker wire is contemplated for use with the present invention. For example, audio grade speaker connection wires are suitable for use with the present invention. The speaker connection wires are typically included with the speaker enclosure, however, speaker enclosures that do not include wiring are also contemplated for use with the mounting board of the present invention.

Figure 7:
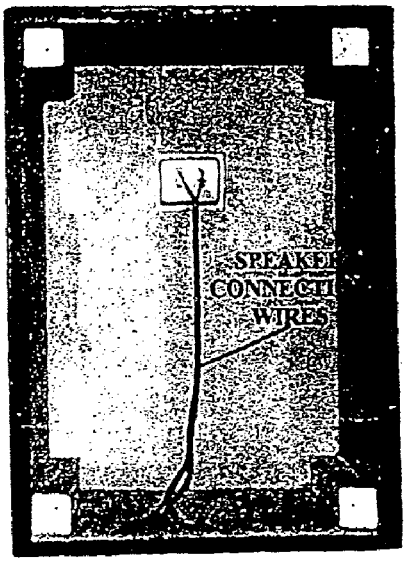
FIG. 7 is a 3-dimensional view of a speaker enclosure having speaker connection wires and a frame for mounting the mounting board of the present invention.

In addition, the speaker enclosure may include a frame for mounting the mounting board. For example, as shown in FIG. 7, the frame may consist of four posts, one at each of the four corners of the speaker enclosure. The frame may be constructed of any material that allows for a sufficiently stable mount of the mounting board. In one embodiment, the frame is made of wood, a wood-type material such as particle board, composite, and the like.

The exterior of the speaker enclosure may be painted, covered, or otherwise treated in order to complement the aesthetic surroundings of the audio or theater system. As such, the selection of the speaker enclosure and grille cloth, foam, or other obscuring cover is preferably done with such treatment in mind for both aesthetic and performance purposes. For example, the obscuring cover is preferably selected so that application of paint does not stiffen the cloth or block the pores of the material.

Kits

The present invention also contemplates a pack or kit that includes the mounting board of the present invention and various other items that may be used for installation of the flush-mount speaker. For example, a kit may include a mounting board as described above and at least one of the following: tools suggested for installation, a speaker enclosure as described above, speaker wiring, a grille cloth, a mounting board frame, a cutting device and fastening devices.

For example, a kit may include a mounting board having at least one grid or pattern appearing thereon, a cutting device, a plurality of fastening devices, a mounting board frame, and a speaker enclosure including a removable grille cloth. The cutting device may be any handheld device that is suitable for cutting through the mounting board. As known to those of ordinary skill in the art, the type of cutting device included in the kit is dependent on the type of material used to fabricate the mounting board. For example, when the material is foam-core or gator board, an x-acto knife, razor, or a comparable cutting device is suitable for inclusion in the kit.

In one embodiment, the plurality of fastening devices are screws and the kit further includes a compatible screwdriver, e.g., a flathead or Phillips screwdriver. In another embodiment, the kit further includes speaker wiring and connectors.

In yet another embodiment, the kit includes a speaker enclosure that is fully assembled with the mounting board attached inside the speaker enclosure. Thus, the parts of the kit in this aspect of the invention would include a fully assembled speaker enclosure, a cutting device, and a device to fasten and unfasten the mounting board from the speaker enclosure.

Method of Installation

The mounting board of the present invention may be used to mount flush-mount speakers that are normally intended to be mounted into the wall, ceiling, or other surface of a room. As such, the present invention is not limited to a particular method of installation, but instead encompasses all methods of installation that result in a flush-mount or in-wall speaker mounted into a speaker enclosure, such as a cabinet or bookshelf enclosure.

Figure 8:
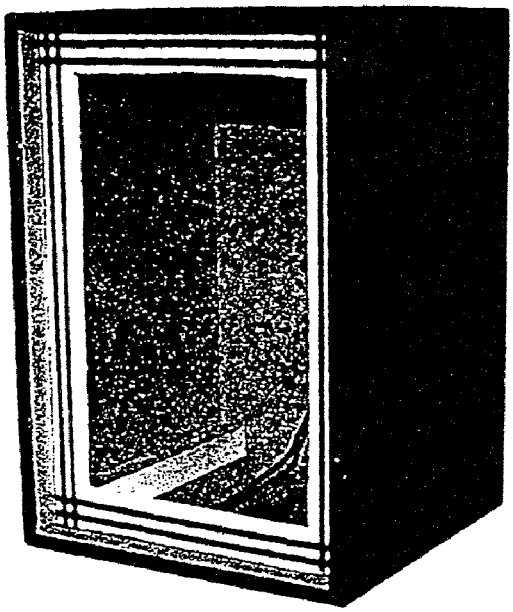
FIG. 8 is a 3-dimensional view of the mounting board of the present invention installed inside of a speaker enclosure.
Figure 9:
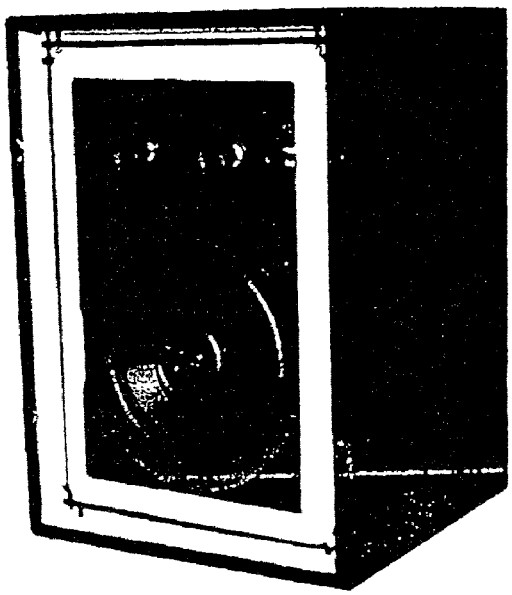
FIG. 9 is a 3-dimensional view of a speaker installed via the mounting board of the present invention inside of a speaker enclosure.

For example, after selecting the particular flush-mount speaker and speaker enclosure, one method of installation includes first preparing the mounting board according to the speaker specifications by using the grid or pattern to cut an opening that fits the speaker. The mounting board is then inserted into the open side of the speaker enclosure (FIG. 8). To ensure stability, the mounting board should be fastened to the speaker enclosure frame. The fasteners may be screws, nails, staples, or the like. As those of ordinary skill in the art are aware the method of fastening the mounting board to the frame and the type of fasteners depend on the material used to construct the frame.

Once the mounting board is securely attached to the frame, the speaker connection wires in the speaker enclosure are connected to the appropriate speaker connection terminals on the back of the speaker. For example, the red connection wire is attached to the red (or positive) speaker wire connection terminal on the back of the speaker and the black connection wire is attached to the black (or negative) speaker wire connection terminal on the back of the speaker. The speaker may then be mounted to the mounting board according to the manufacturer's installation instructions for the speaker. Finally, the grille cloth is reattached to the speaker enclosure.

EXAMPLE

The following non-limiting example is merely illustrative of the preferred embodiments of the present invention, and are not to be construed as limiting the invention, the scope of which is defined by the appended claims.

Example

Two-Sided Speaker Mounting Board

A speaker mounting board was fabricated from one-half inch thick foam-core board according to the present invention having a linear grid on one side and a circular pattern on the reverse side (FIGS. 1 and 2). The linear grid consisted of horizontal cutting lines beginning at a distance of 4 inches above and below the center of the mounting board. Horizontal cutting guides were spaced at integrals of 0.25 inches continuing toward the outer perimeter of the mounting board, but leaving a border of 0.25 inches at the top and bottom of the mounting board. Similarly, vertical cutting guides began left and right of the center at a distance of 2.5 inches from the center of the mounting board. Subsequent vertical cutting guides were spaced at intervals of 0.25 inches from each other. The grid allowed fro left and right borders of 0.25 inches.

The mounting board was cut, using a razor knife, according to speaker specifications and secured to a frame inside a speaker enclosure using four screws (FIG. 8). The speaker connection wires were connected to the back of the speaker and the speaker was secured to the mounting board following the speaker manufacturer's installation instructions. The grille cloth was then attached to the front of the speaker enclosure.

The mounted speaker was tested for durability and tightness of fit, i.e., coming unsecured from the mounting board. After repeated impact tests, e.g., shaking the speaker forward and backward, the speaker remained secure within its mount.

Other than in the operating examples, or unless otherwise expressly specified, all of the numerical ranges, amounts, values and percentages such as those for the dimensions of the grid or patterns of the mounting boards and the dimensions of the speaker enclosures, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. For example, the mounting board of the invention may also be used in combination with other audio/visual equipment for automobiles. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A kit for a universal audio speaker mount comprising:

a mounting board having a front side and a back side and a first pattern appearing on at least one of the front side or back side, wherein the first pattern comprises a plurality of cutting guides adaptable to at least two speaker sizes, and wherein the mounting board is formed of sheet material comprising gator board, foam-core board, corrugated cardboard, plastic, honeycomb board, cork, sheetrock, fiber-reinforced polymer, and combinations thereof;

a box-type speaker enclosure comprising a mounting board frame and speaker connection wires;

a cutting device;

a fastening device; and a plurality of fasteners.

2. The kit of claim 1, wherein the mounting board has a first pattern on the front side and a second pattern on the back side, and wherein the first pattern has a plurality of horizontal cutting guides and a plurality of vertical cutting guides, and wherein the second pattern comprises a plurality of cutting guides having a circular shape, an elliptical shape, a hexagonal shape, or an octagonal shape.

3. The kit of claim 2, wherein the plurality of cutting guides of the second pattern comprises a first cutting guide in a circular shape having a first diameter, a second cutting guide in a circular shape having a second diameter at least 0.5 inches greater than the first diameter, and a third cutting guide in a circular shape having a third diameter at least 0.5 inches greater than the second diameter.

4. The kit of claim 2, wherein the first and second patterns are printed, adhesively connected, stamped, impressed, painted, or etched onto the mounting board.

5. The kit of claim 1, wherein the fastening device is a screwdriver, the plurality of fasteners comprises at least four screws, and the cutting device is a razor blade.

6. The kit of claim 1, wherein the mounting board frame comprises corner mounts at each of the four corners of the box-type speaker enclosure.

7. The kit of claim 1, wherein the plurality of cutting guides comprises a plurality of horizontal cutting guides and a plurality of vertical cutting guides.

8. A kit for a universal audio speaker mount comprising:

a mounting board sized to fit within a box-type speaker enclosure, wherein the mounting board comprises:

a front side having a first pattern comprising a first plurality of cutting guides adaptable to at least two speaker sizes, wherein the first plurality comprises a plurality of horizontal cutting guides and a plurality of vertical cutting guides; and a back side having a second pattern comprising a second plurality of cutting guides adaptable to at least two speaker sizes and having a circular shape, an elliptical shape, a hexagonal shape, or an octagonal shape;

a box-type speaker enclosure comprising a mounting board frame and speaker connection wires;

a cutting device;

a fastening device; and a plurality of fasteners.

9. The kit of claim 8, wherein the mounting board is formed of sheet material comprising gator board, foam-core board, corrugated cardboard, plastic, honeycomb board, cork, sheetrock, fiber-reinforced polymer, and combinations thereof.

10. The kit of claim 8, wherein the plurality of horizontal cutting guides and the plurality of vertical cutting guides are spaced at intervals of 0.25 inches.

11. The kit of claim 8, wherein the mounting board has an outer perimeter, and wherein the mounting board has a border of 0.25 inches around the outer perimeter.

12. The kit of claim 8, wherein the first and second patterns are adaptable to at least four speaker sizes.

13. The kit of claim 12, wherein the first and second patterns are adaptable to at least six speaker sizes.

14. The kit of claim 8, wherein the first and second patterns are printed, adhesively connected, stamped, impressed, painted, or etched onto the mounting board.

15. A kit for a universal audio speaker mount comprising:

a mounting board having a thickness of about 0.1 inch to about 2 inches and a first side and a second side, wherein the first side comprises a first pattern and the second side comprises a second pattern, wherein the first pattern comprises a first plurality of cutting guides adaptable to at least two speaker sizes, and wherein the first plurality of cutting guides comprises a plurality of horizontal cutting guides and a plurality of vertical cutting guides, wherein the second pattern comprises a second plurality of cutting guides adaptable to at least two speaker sizes, and wherein the second plurality of cutting guides comprises circular shape, an elliptical shape, a hexagonal shape, or an octagonal shape;

a box-type speaker enclosure comprising a mounting board frame and speaker connection wires;

a cutting device;

a fastening device; and a plurality of fasteners.

16. The kit of claim 15, wherein the first and second patterns are adaptable to at least four speaker sizes.

17. The kit of claim 15, wherein the first and second patterns are adaptable to at least six speaker sizes.

18. The kit of claim 15, wherein the mounting board is formed of sheet material comprising gator board, foam-core board, corrugated cardboard, plastic, honeycomb board, cork, sheetrock, fiber-reinforced polymer, and combinations thereof.

19. The kit of claim 15, wherein the thickness of the mounting board ranges from about 0.25 inch to about 1.5 inches.

20. The kit of claim 19, wherein the thickness of the mounting board ranges from about 0.5 inch to about 0.625 inch.

* * * * *